US005351632A

United States Patent [19]

Mann

[11] Patent Number: 5,351,632

[45] Date of Patent: Oct. 4, 1994

[54] TOP FIRED BURN-OFF OVEN

[76] Inventor: Carlton B. Mann, 3403 Lynnwood, Tyler, Tex. 75701

[21] Appl. No.: 125,004

[22] Filed: Sep. 23, 1993

[51] Int. Cl.[5] ..... F23N 5/02

[52] U.S. Cl. ..... 110/190; 110/214; 110/236; 110/346

[58] Field of Search ..... 110/229, 236, 190, 346; 588/209, 213, 216, 220, 234, 240, 245

[56] References Cited

U.S. PATENT DOCUMENTS 3,305,309 2/1967 Woodland et al. ..... 588/209
4,141,373 2/1979 Kartanson et al. ..... 110/236 X
4,270,898 6/1981 Kelly ..... 432/19
4,557,203 12/1985 Mainord ..... 110/344
4,759,298 7/1988 Koptis et al. ..... 110/190
4,827,855 5/1989 Koptis et al. ..... 110/345
4,970,969 11/1990 Koptis et al. ..... 110/190
5,018,458 5/1991 McIntyre et al. ..... 110/346

*Primary Examiner*—Edward G. Favors
*Attorney, Agent, or Firm*—John F. Bryan, Jr.

[57] ABSTRACT

An oven for cleaning parts by a pyrolytic burn-off process is fired by a primary burner which heats the oven chamber from the top downwardly and the combustion gases, along with pyrolized volatile constituents, are withdrawn from the lowermost portion of the chamber and into an afterburner for final decomposition and discharge into the atmosphere.

10 Claims, 1 Drawing Sheet

TOP FIRED BURN-OFF OVEN

FIELD OF THE INVENTION

The present invention relates to pyrolytic burn-off ovens operating with a combustible atmosphere and, more particularly, to the nature of the working process and control thereof in such ovens.

BACKGROUND AND SUMMARY OF THE INVENTION

Burn-off ovens work with combustible atmosphere in a pyrolytic, or oxygen deprived process to remove organic waste. A "charge" of materials for processing is placed in an insulated primary chamber which is fired from the bottom, with combustion gases and vaporized volatile constituents being carried off by an exhaust stack at the top of the oven. A circulation pattern in the oven interior is initiated by burner discharge flow, passes through and around the charge, is continued by convection and completed by the low pressure of exhaust stack draft and/or aspiration into an afterburner system. Bottom firing is a child of the hearth and the baking oven, refined over the years, and is ideal for most processes. Waste incineration, for example, where the heat of bottom firing rises to preheat the charge and where the burning of underneath materials helps kindle the top loaded material, is well served by this practice.

The earliest burn-off furnace rightfully deserved its name, when organic materials such as paint or oil were literally burned from metal parts. From this beginning evolved the present pyrolytic oven, wherein organic materials are vaporized in an oxygen poor atmosphere to leave only the inorganic ash, without combustion. In this method, parts being cleaned are not subjected to such high temperatures as they were previously. Afterburners, which were developed for use on incinerators, were soon added for control of smoke and odor, arriving at the configuration of the accepted, present day burn-off oven.

Practitioners of the art have given us improved methods for control of pyrolytic ovens, as disclosed by Kelly, U.S. Pat. No. 4,270,989; Mainord, U.S. Pat. No. 4,557,203; Koptis, et al, U.S. Pat. Nos. 4,759,298 & 4,827,855; and the present inventor, Mann, U.S. Pat. No. 5,189,963. However, in each of the foregoing, it is to be noted that oven configuration has remained essentially static, so that, aside from control methodology, there is little to distinguish one bottom fired burn-off oven from the next.

Top firing, although known and used on some curing and heat treating ovens, has heretofore been been considered inappropriate for use in burn-off ovens by practitioners of the art. The bottom fired process has been seen as a synergy of "rising heat" while top firing is thought of as ineffective and unsuited to burn-off. Because both burn-off ovens and incinerators are fired waste disposal processes with stringent emission controls, they have been viewed as closely related, in spite of the unique nature of pyrolysis. In truth, burn-off oven design has evolved from incinerator practice more so than as an independent and unrelated art.

The pyrolytic process has thus, been made to work under compromising conditions. Hot combustion gases, at up to 1,200° F., play directly on parts being cleaned and on the carts carrying them, risking parts damage and maintenance problems. Also, concentrations of dense combustible gases tending to collect in undisturbed pockets inside the oven complicate control and pose a lingering threat of fire or explosion. Thus, prudence causes us to control the process slowly and carefully, while surplus heat goes up the exhaust stack. Objects of the present invention therefore, are to provide method and means for conducting pyrolytic cleaning processes in a readily controlled manner, with minimized risk of damage to the contents, with better energy efficiency and improved safety.

These objects are achieved in the present invention by literally turning the process upside-down; introducing hot combustion gases at the upper level of the oven chamber and exhausting cooler gases from the lower level. The hot gases rise and spread out over the length and width of the oven and, as the top of the chamber is heated, the gases cool and descend. The charge is progressively heated from above as the temperature builds downwardly and pyrolysis of the organic materials proceeds accordingly. Progressive pyrolysis makes fire and explosion suppression less demanding, in clear contrast to the result of direct firing from underneath, where heat rises through the charge. The control system is adapted to "top-down" oven characteristics by placing a thermocouple at the chamber top, the hottest location in the oven, for control of the primary burner and/or water cooling. Another thermocouple, preferably placed at the chamber bottom, the coolest location in the oven, may be used to assist in controlling duration of the process. The temperature differential between the top and bottom is greatest when heating starts and decreases as oven heating progresses, reaching a minimum at the stable, or "steady state", fully heated condition. Another reason that others have considered "top-down" inappropriate for burn-off ovens is the characteristic of frequently cutting back the primary burner for cooling as the oven heats, making the process seem too slow and inefficient.

The top-down heating process has produced unanticipated advantages. Ash released into the atmosphere is reduced, a result of not exposing the charge directly to the velocity of burner gases, and oven temperature control is smoother and more predictable. This is ascribed both to the ease with which the top mounted cooling spray reaches the hottest gases in the oven and also to permitting a natural, downward flow of the relatively dense organic vapors. The downward flow takes organic vapors away as they are formed, to be processed steadily and smoothly in the afterburner. The exothermic energy contributed by these organic vapors had been considered to be a plus for process efficiency in bottom fired ovens but now, taking the energy directly to the afterburner has proven to increase overall efficiency as well as reduce parts damage.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
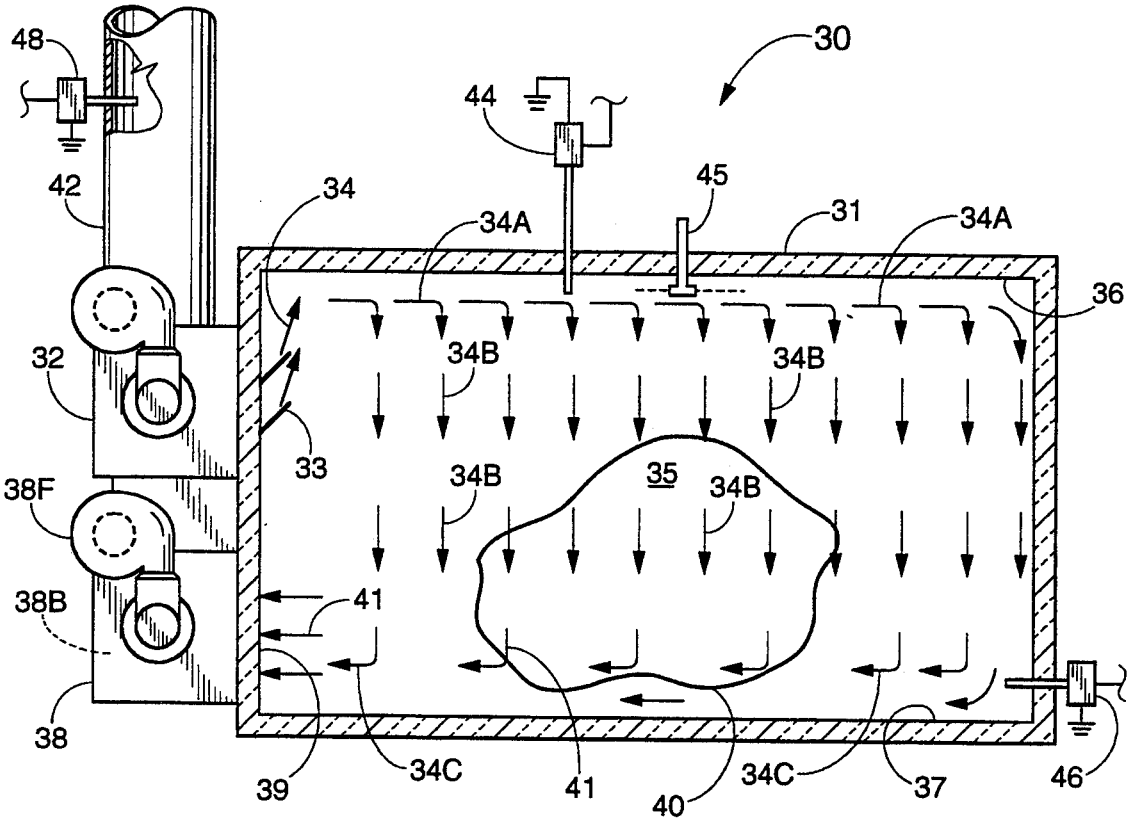
FIG. 1 is a cross section view of a preferred embodiment of the present invention.

FIG. 1 shows the oven 30 of the present invention with insulated enclosure 31 and oven chamber 35. Primary burner assembly 32, which is preferably mounted externally to chamber 31, operates in the same manner as in prior art ovens, discharging hot, oxygen poor combustion gases 34. In this case, however, the gases 34 are directed into the upper portion of chamber 35 and spread out along its length and width as indicated by arrows 34A. Louvers 33 are included to deflect gases 34 upwardly to chamber top 36 but this may also be accomplished purely by convection. As gases 34 heat the chamber top 36 they cool and begin to settle as indicated by arrows 34B. Thus, oven chamber 35 is progressively heated from the top-down as is the charge 40 of parts being cleaned. Gases 34, now further cooled and accompanied by additional gases as indicated by arrows 41, comprising vaporized organic materials from charge 40 and including combustible constituents, settle toward furnace bottom 37. Together, gases 34 and 41 are drawn toward and into inlet 39 of afterburner assembly 38, as indicated by arrows 34C. Afterburner assembly 38 includes burner 38B and fan 38F for supply of an excess of air so that here and in stack 42, thermal decomposition of gases 41 is completed prior to discharge into the atmosphere.

Control of the process in preferred embodiment 30 is maintained by monitoring temperatures with high thermocouple 44, low thermocouple 46 and stack thermocouple 48. High thermocouple 44, located at the top of oven chamber 35, the hottest place in oven 30, operates to initiate cooling whenever a predetermined maximum temperature (setpoint) is exceeded. Cooling is achieved by reducing the output of primary burner assembly 32 and/or by activation of cooling water spray 45. In this manner it is assured that the temperature of charge 40 will never exceed setpoint temperature. In a typical operation, solid organic volatiles vaporize to become combustible gases at something around 650° F., while the setpoint must be high enough to remove carbonaceous char, or about 800° F. Although pyrolysis can be controlled by other methods known to the art, in the preferred embodiment 30, temperatures read by high thermostat 44 are additionally monitored for rate-of-change control in accordance with U.S. Pat. No. 5,189,963, the contents of which are incorporated herein by reference.

Over time, chamber bottom 37 reaches a stable temperature, usually about 100° F. below setpoint. A steady state condition can then be held with minimal input required of primary burner 32, providing for efficient completion of the pyrolytic process. A differential temperature controller will allow changing the setpoint without making a secondary temperature adjustment for chamber bottom 37. It is noteworthy that in a comparable bottom fired furnace there is a top to bottom heat differential of more than 400° F. and that the hotter gases are going up the stack. This gives some insight into the basis for the improved efficiency of the present invention.

Thermocouple 48 measures temperature in exhaust stack 42 and these temperatures are also monitored for rate-of-change control in accordance with U.S. Pat. No. 5,189,963. When this rate-of-change approaches zero and the top to bottom temperature differential approaches the predetermined minimum, a timed "soak" period is initiated to allow the parts being cleaned to reach the surrounding temperature and burn off any residual carbon deposits. The soak period required is a function of the carbon percentage in the organic materials removed and the geometry and weight of the parts being cleaned. Paint line fixtures may require one-half hour and engine blocks may require two hours but, once determined, soak time remains a constant for a given industry, allowing completely automatic process control.

Figure 2:
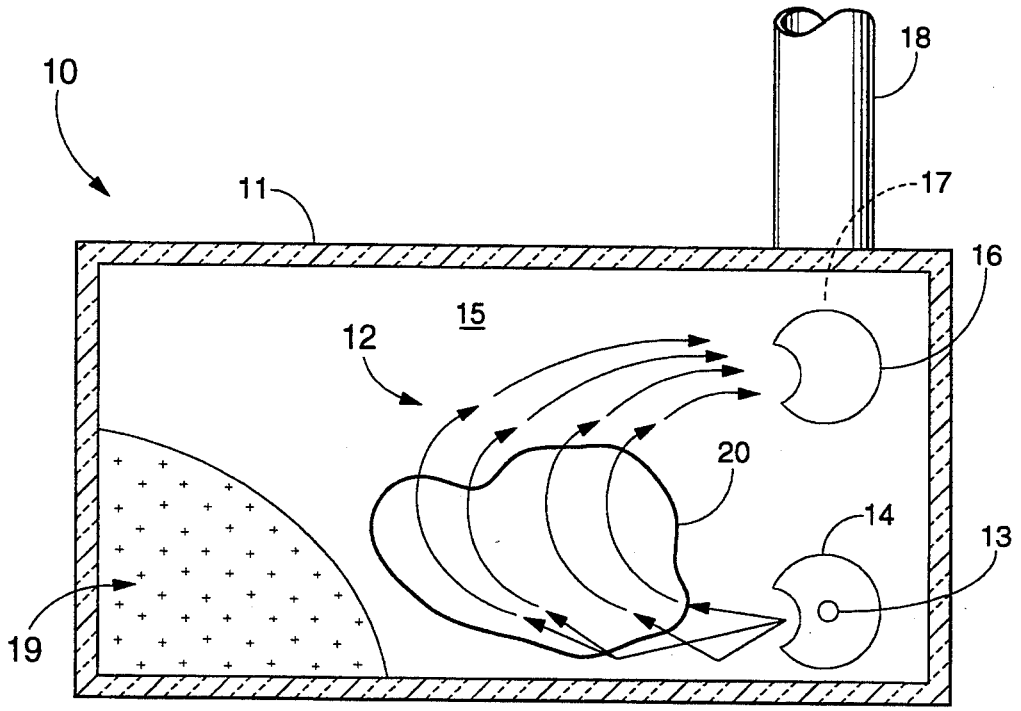
FIG. 2 PRIOR ART
FIG. 2 is a cross section view of a conventional burn-off oven showing the flow of gases in the chamber.

FIG. 2, a cross-sectional view of the burn-off oven 10 as taught by prior art, is shown to illustrate the contrast of this invention to previous teachings. Here is seen an insulated enclosure 11 for oven chamber 15 wherein a regulated flow of pressurized gaseous fuel is mixed with a limited flow of air and burned at primary burner 13. Oxygen poor, hot combustion gases 12 are produced at the outlet of combustion chamber 14 and are distributed into chamber interior 15 while passing through and around charge 20 of parts being cleaned. Circulation is unforced, since the discharge velocity of combustion gases 12 is relatively low, and convection forces bend the flow path upward. Pressure at afterburner inlet 16 is reduced by the draft of exhaust stack 18 and aspiration to afterburner 17. An undisturbed zone 19 is seen, low within chamber interior 15 and outside the flow path of hot combustion gases 12, where dense volatile gases can collect and become relatively cool. An improved control system for such ovens is described in U.S. Pat. No. 5,189,963.

It is to be understood that the present invention is not limited to the disclosed embodiment and may be expressed by rearrangement, relocation, modification or substitution of parts or steps within the spirit thereof.

I claim:

1. A pyrolytic burn-off oven for processing materials with volatile constituents, comprising:

a chamber for containing materials with volatile constituents, the interior of which includes a top, an upper portion, a lower portion and a bottom;

means at said upper portion for heating the chamber interior and materials contained therein from the top downwardly;

means for controlling the heating means so as to vaporize volatile constituents of the materials; and means at said lower portion for exhausting the vaporized volatile constituents.

2. A pyrolytic burn-off oven according to claim 1 wherein the means for heating comprises:

a pressurized gaseous fuel supply including means for regulating the flow of fuel supplied;

means for supplying a limited flow of air;

means for mixing the flows of fuel and air;

means for burning the fuel and air mixture to provide hot, oxygen poor combustion gases; and means for directing these hot combustion gases to the upper portion of the chamber interior.

3. A pyrolytic burn-off oven according to claim 1 wherein the means for controlling comprises:

a predetermined maximum temperature at a location within the chamber interior;

sensing means for measuring temperature at said location; and means for operating said regulating means to reduce the volume of fuel gas supplied for burning whenever the measured temperature exceeds said predetermined maximum;

4. A pyrolytic burn-off oven according to claim 1 wherein the means for controlling comprises:

a predetermined maximum temperature at a location within the chamber interior;

sensing means for measuring temperature at said location; and means for spraying water into the chamber interior whenever the measured temperature exceeds said predetermined maximum.

5. A pyrolytic burn-off oven according to claim 1 wherein the means for exhausting comprises:

a blower fan for supplying a flow of air;

means for drawing gases from the lower portion of the chamber interior to be mixed into said flow of air;

means for heating the mixture of gases so drawn and air so as to decompose volatile constituents therein; and means for directing the decomposed volatile constituents upward, into the atmosphere.

6. A pyrolytic burn-off oven according to claim 1 wherein the means for controlling comprises:

a predetermined maximum temperature rate-of-change within the chamber interior;

sensing means for measuring temperature at a location within the chamber interior;

means for determining the rate-of-change of said measured temperature; and means for operating said regulating means to reduce the volume of fuel gas supplied for burning whenever the temperature rate-of-change exceeds said predetermined maximum.

7. A pyrolytic burn-off oven according to claim 1 wherein the means for controlling comprises:

a predetermined maximum temperature rate-of-change within the chamber interior;

sensing means for measuring temperature at a location within the chamber interior;

means for determining the rate-of-change of said measured temperature; and means for spraying water into the chamber interior whenever the temperature rate-of-change exceeds said predetermined maximum.

8. A pyrolytic burn-off oven according to claim 5 wherein the means for controlling comprises:

a predetermined maximum temperature rate-of-change within the means for heating gases so drawn;

sensing means for measuring temperature at a location within said means for heating drawn gases;

means for determining the rate-of-change of said measured temperature; and means for operating said regulating means to reduce the volume of fuel gas supplied for burning whenever the temperature rate-of-change exceeds said predetermined maximum.

9. A pyrolytic burn-off oven according to claim 5 wherein the means for controlling comprises:

a predetermined maximum temperature rate-of-change within the means for heating drawn gases;

sensing means for measuring temperature at a location within said means for heating drawn gases;

means for determining the rate-of-change of said measured temperature; and means for spraying water into the chamber interior whenever the temperature rate-of-change exceeds said predetermined maximum.

10. A method of operating a pyrolytic burn-off oven comprising the steps of:

(A) charging the chamber of said oven with a load including volatile organic constituents;

(B) burning fuel in a primary burner and discharging the hot gases produced by this burning into the upper portion of the oven chamber while maintaining an oxygen poor atmosphere in said chamber;

(C) allowing the hot gases to spread across and heat the top and upper portion of the oven chamber, thereby cooling said hot gases;

(D) allowing the hot gases so cooled to descend to a lower level in the oven chamber;

(E) drawing gases from the lower portion of the oven chamber while continuing steps (B), (C) and (D) until the charged materials are heated so as to volatilize organic constituents thereof;

(F) passing the gases so drawn through a high temperature, oxygen rich environment so as to promote decomposition of the volatilized organic constituents for release into the atmosphere.

* * * * *